US006807918B2

(12) United States Patent
Chang

(10) Patent No.: US 6,807,918 B2
(45) Date of Patent: Oct. 26, 2004

(54) ROTARY SHUTTLE DEVICE FOR SEWING MACHINE

(75) Inventor: Steve Chang, Seoul (KR)

(73) Assignee: Kobest Co., LTD, Seoul (KR)

( * ) Notice: Subject to any disclaimer, the term of this patent is extended or adjusted under 35 U.S.C. 154(b) by 2 days.

(21) Appl. No.: 10/312,837

(22) PCT Filed: Jul. 10, 2001

(86) PCT No.: PCT/KR01/01180

§ 371 (c)(1),
(2), (4) Date: Dec. 31, 2002

(87) PCT Pub. No.: WO02/04732

PCT Pub. Date: Jan. 17, 2002

(65) Prior Publication Data

US 2003/0172859 A1 Sep. 18, 2003

(30) Foreign Application Priority Data

Jul. 12, 2000 (KR) ..... 2000-0039823

(51) Int. Cl.[7] ..... D05B 57/16
(52) U.S. Cl. ..... 112/230
(58) Field of Search ..... 112/189, 191, 112/232, 228, 230, 231

(56) References Cited

U.S. PATENT DOCUMENTS 2,869,495 A * 1/1959 Bono ..... 112/230
4,660,487 A * 4/1987 Mikuni ..... 112/230
5,474,004 A * 12/1995 Badillo ..... 112/230
5,617,803 A * 4/1997 Badillo ..... 112/230

* cited by examiner

*Primary Examiner*—Ismael Izaguirre
(74) *Attorney, Agent, or Firm*—Dykema Gossett PLLC

(57) ABSTRACT

A rotary shuttle device for a sewing machine, including an outer shuttle having a main body integrally provided with a base portion disposed at the driving shaft, a first supporting portion protruding from one side of the base portion to have a first partial track groove on an inner face thereof, and a second supporting portion protruding from the other side of the base portion opposite to the first supporting portion and having a second partial track groove on an inner face thereof; a track groove member is removably disposed between the first and second supporting portion and has a third partial track groove communicated with the first partial track groove of the first supporting portion and the second partial track groove of the second supporting portion; and a groove member is removably fixed to the second supporting portion of the main body.

9 Claims, 5 Drawing Sheets

ROTARY SHUTTLE DEVICE FOR SEWING MACHINE

TECHNICAL FIELD

The present invention relates to a sewing machine, and more particularly, a rotary shuttle device for the sewing machine, which is formed with separated three parts that are removably coupled or assembled each other so as to be capable of facilely and conveniently repairing or replacing only a corresponding worn portion or a portion that requires replacement.

BACKGROUND ART

Generally, a sewing machine, as shown in FIG. 1, has a rotary shuttle device for supplying an under thread. The rotary shuttle device comprises an outer shuttle which is disposed at a driving shaft 1 rotatably connected to a power generating unit, an inner shuttle 3 which is received in the outer shuttle 2, a bobbin 4 which is received in the inner shuttle 3 and on which the under thread is wound, and a bobbin case 5 for receiving the bobbin 4. Typically, the bobbin 4 is formed with a cylindrical winding drum 6 on which the under thread is wound, and a flange portion 8, 9 which is fixed to both ends of the winding drum 6. On a bottom portion 7 of the inner shuttle 3, a stud 10 is disposed upright toward an open end side thereof. The winding drum 6 of the bobbin 4 is rotatably inserted onto the stud 10. The outer shuttle 2 has a track groove 11 formed at an inner portion thereof and a pointed end 12 formed at one end thereof. A groove 13 is formed adjacent to the pointed end 12 to have a gentle radius of curvature so that the under thread is passed through the groove 13, while being contacted with the groove 13. On an outer side of the inner shuttle 3 is formed a track portion 14 which is inserted into the track groove 11. Therefore, the inner shuttle 3 is rotatably mounted in the outer shuttle 2. Meanwhile, a semicircular guide portion 15 is fixed to one half portion of an outside portion of the outer shuttle 2 by fastening means such as a bolt so as to rotatably and removably mount the inner shuttle 3 in the outer shuttle 2. The guide portion 15 has a pointed end 16 opposite to the pointed end 12 formed at a main body of the outer shuttle 2. In addition, a bracket 18 is removably fixed to the other half portion of the outside portion of the outer shuttle 2 by the fastening means such as the bolt to be continuous with the guide portion 15. The bracket 18 has a pointed end 19 opposite to the pointed end 16 of the guide portion 15. According to a construction as described above, when a sewing device is operated, the outer and inner shuttles 2, 3 are relatively rotated, and at the same time, the under thread wound on bobbin 4 is pulled out and supplied through the groove 13 formed adjacent to the pointed end 12 of the outer shuttle 2 to a lower portion of cloth to be sewn. Then, the under thread is sewn into the cloth in cooperation with an upper thread supplied from an upper portion of the cloth.

However, there are some problems in the conventional rotary shuttle device for a sewing machine. That is, since the under thread pulled out of the bobbin 4 during the rotation of the inner shuttle 3 at high speed is passed through the groove 13 of the outer, while being contacted with the groove 13, the groove 13 is worn. In case the groove is locally worn, the under thread is caused to be broken. In the worst case, a portion of the groove 13 is cut out. In this case as well as the case that only the portion of the groove 13 is excessively worn, the outer shuttle 2 or the whole rotary shuttle device has to be replaced with new one. Therefore, there is a problem that costs a great deal. And since the inner shuttle 3 is rotated with respect to the outer shuttle 2 at the high speed, the track portion 14 formed at an outer circumference of the inner shuttle 3 wears the track groove 11. If the track groove 11 is excessively worn, the inner shuttle 3 is shaken or abnormally rotated. The under thread is broken, or the shuttle device is entirely out of order to cause sewing defect or make it impossible to perform the sewing operation. In this case, since the expensive outer shuttle or whole rotary shuttle device has to be replaced, , there is also the problem that costs a great deal.

Further, since an open space of the outer shuttle for receiving the inner shuttle is very limited and restricted and it is also very difficult to exactly insert the track portion of the inner shuttle into the track groove of the outer shuttle, there is a problem of lowering work efficiency and assembly efficiency.

Moreover, since the guide portion is essentially provided to the outers shuttle in order to insert the inner shuttle into the outer shuttle, the number of components is increased and thus the number of the fastening means such as the bolt for fastening the components is increased. Therefore, there is a problem of increasing fabrication cost as well as lowering the work-efficiency.

DISCLOSURE OF THE INVENTION

Therefore, it is an object of the present invention to provide a rotary shuttle device for a sewing machine, which is capable of selectively replace only an excessively worn portion or a portion that requires replacement so as to reduce maintenance cost.

It is other object of the present invention to provide a rotary shuttle device for a sewing machine, which is capable of selectively replace only a groove member of an outer shuttle or a track groove member worn by a track portion of an inner shuttle.

It is another object of the present invention to provide a rotary shuttle device for a sewing machine, which is separately formed with a main body, a groove member and a track groove member.

It is yet another object of the present invention to provide a rotary shuttle device for a sewing machine, which is capable of facilely inserting an inner shuttle into an outer shuttle.

To accomplish the above objects and advantages, there is provided a rotary shuttle device for a sewing machine, comprising an outer shuttle that is disposed at a driving shaft of a power generating unit of the sewing machine, a bobbin which is rotatably disposed in an inner shuttle so that an under thread is wound thereon, a bobbin case for receiving the bobbin and a bracket which is disposed around the outer shuttle, characterized in that, the outer shuttle comprises a main body integrally provided with a base portion which is disposed at the driving shaft, a first supporting portion which is protruded at one side of the base portion to have a first partial track groove on an inner face thereof, and a second supporting portion which is protruded at the other side of the base portion to be opposite to the first supporting portion and have a second partial track groove on an inner face thereof; a track groove member which is removably disposed between the first and second supporting portion and has a third partial track groove communicated with the first partial track groove of the first supporting portion and the second partial track groove of the second supporting portion; and a groove member which is removably fixed to the second supporting portion of the main body, and formed with a pointed end, a groove through which the under thread wound on the bobbin is passed while being contacted therewith and a fourth partial track groove communicated with the second partial track groove of the second supporting portion.

BRIEF DESCRIPTION OF THE DRAWINGS

The above object, other features and advantages of the present invention will become more apparent by describing the preferred embodiment thereof with reference to the accompanying drawings, in which.

BEST MODE FOR CARRYING OUT THE INVENTION

Now, preferred embodiments of the present invention will be described in detail with reference to the annexed drawings.

Figure 1:
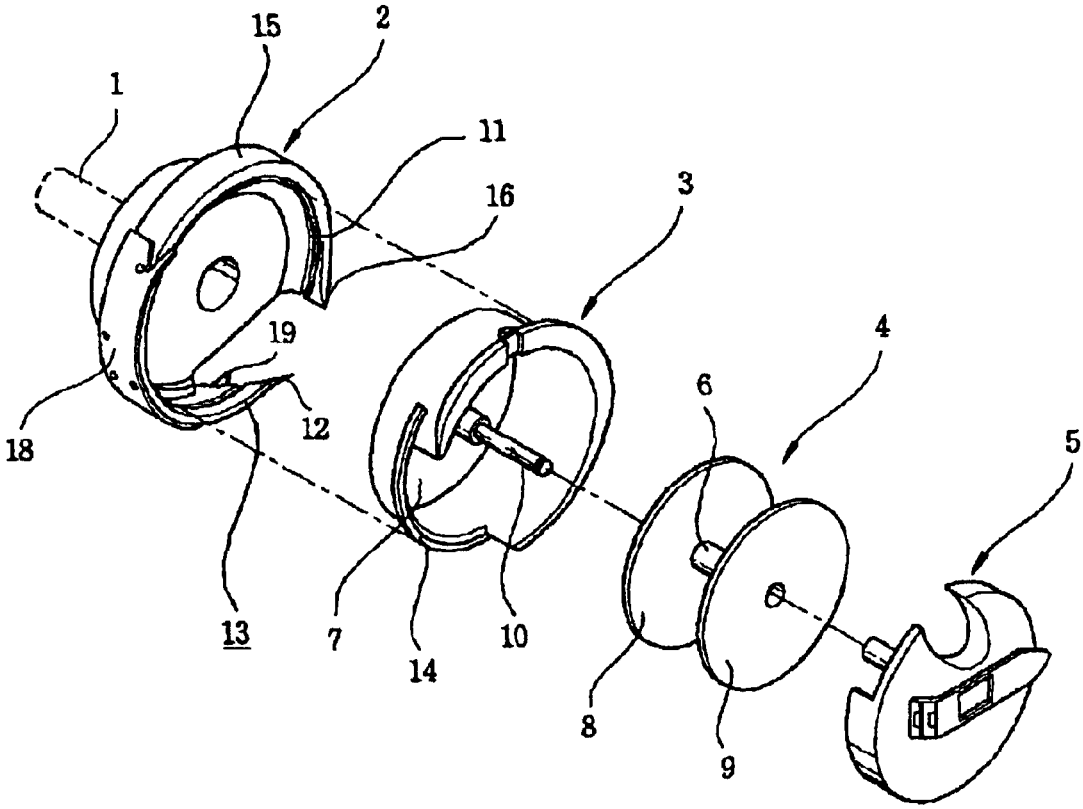
FIG. 1 is an exploded perspective view of a conventional rotary shuttle device for a sewing machine.
Figure 2:
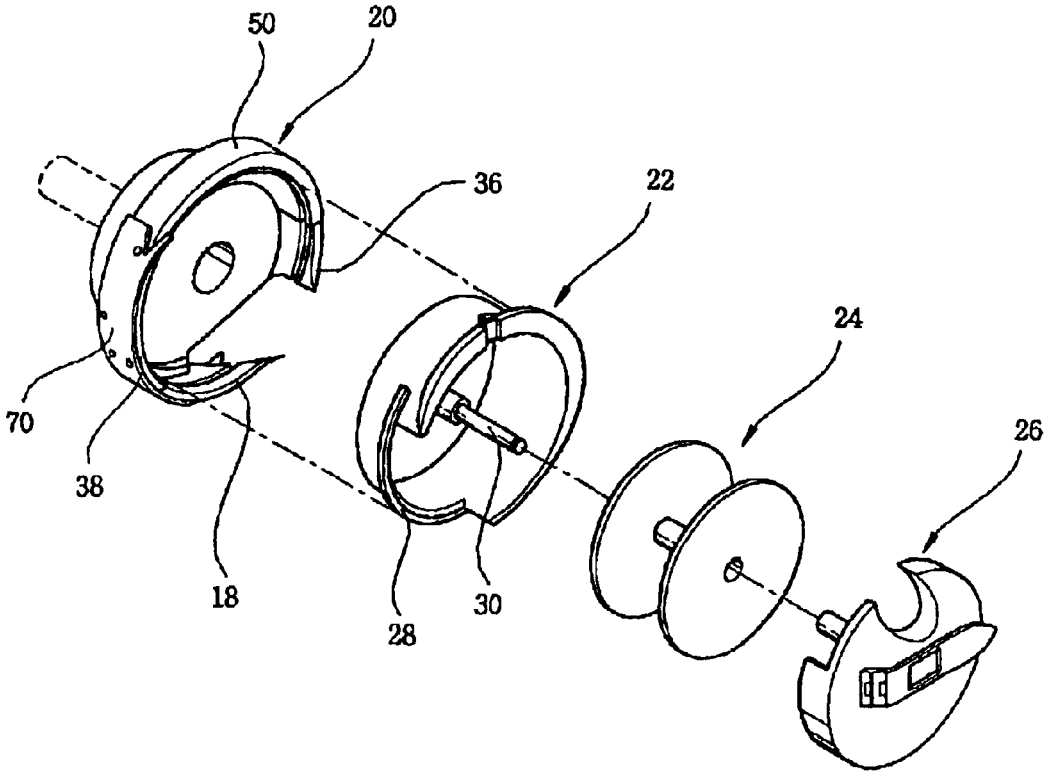
FIG. 2 is an exploded perspective view of a rotary shuttle device for a sewing machine according to one embodiment of the present invention.

Referring to FIG. 2, a rotary shuttle device according to one embodiment of the present invention basically comprises an outer shuttle 20, an inner shuttle 22 which is rotatably inserted into the outer shuttle 20, a bobbin 24 which rotatably disposed in the inner shuttle 22, and a bobbin case 26 for receiving the bobbin 24. On an outer circumference of the inner shuttle 22, there is formed a track portion 28. On an inner center portion of the inner shuttle 22, a stud 30 is disposed upright toward an open end side thereof. The bobbin 24 is rotatably inserted onto the stud 30. The inner shuttle 22, the bobbin 24 and the bobbin case 26 comprising the rotary shuttle device of the present invention may be constructed by a general method as described in the conventional device. Therefore, the description of them will be omitted.

Figure 3:
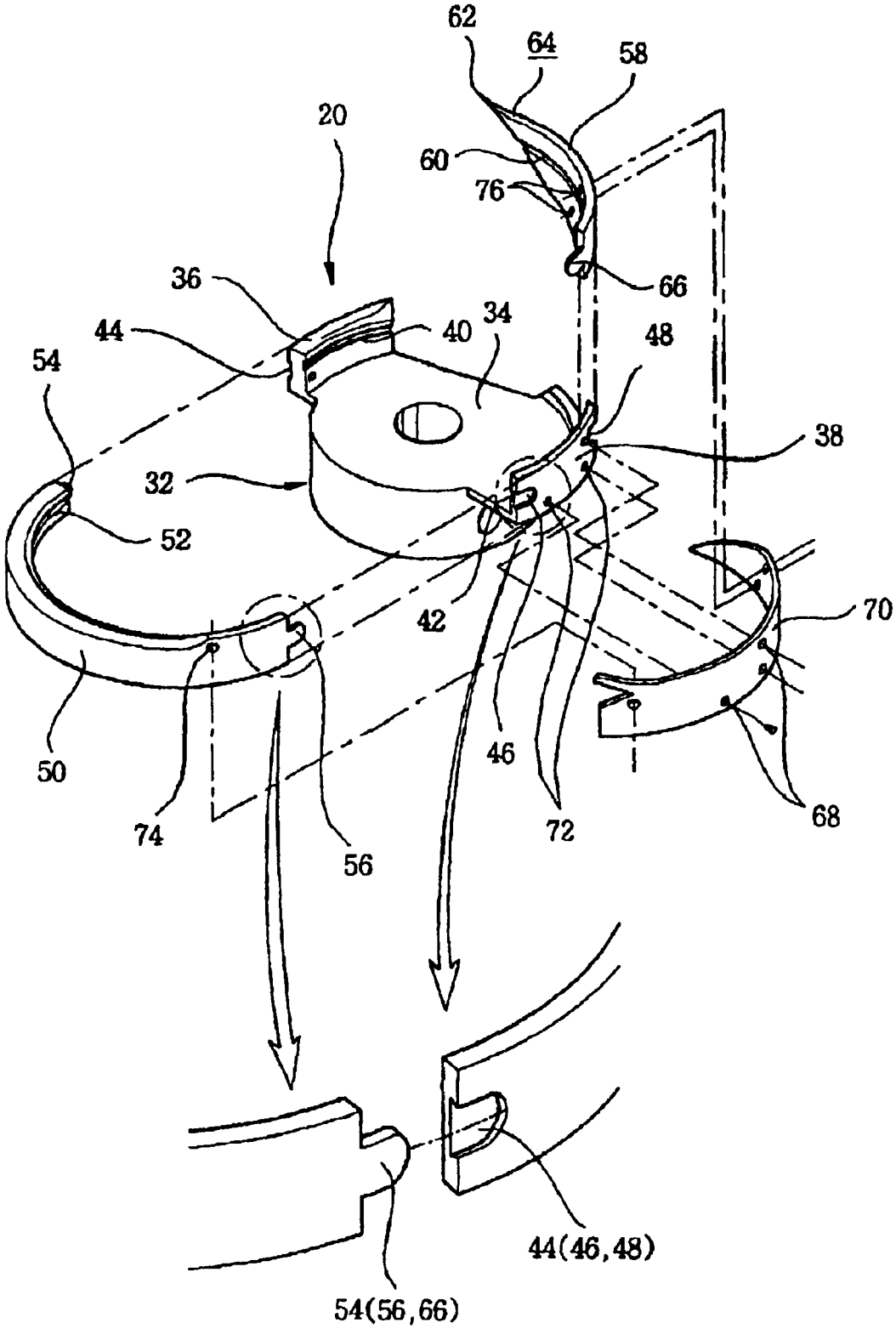
FIG. 3 is an exploded perspective view of an outer shuttle of the rotary shuttle device shown in FIG. 2.
Figure 5:
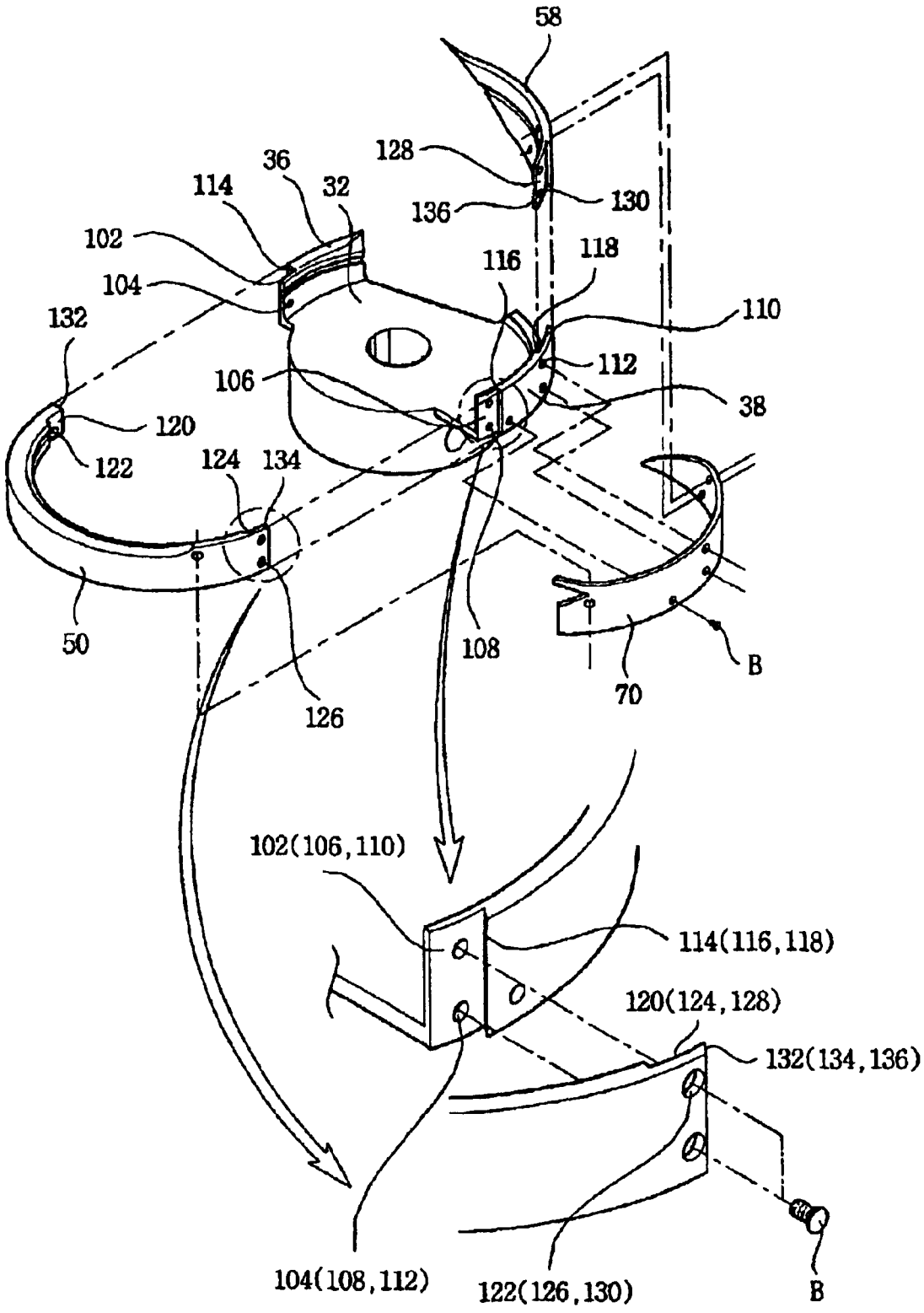
FIG. 5 is an exploded perspective view of the outer shuttle of the rotary shuttle device according to another embodiment of the present invention.

As shown in FIG. 3, the outer shuttle 20 of the rotary shuttle device of the present invention has a main body 32 that is connected to a driving rod of a driving unit disposed at a sewing machine. The main body 32 comprises a base portion 34 having a mounting hole, a first supporting portion 36 which is integrally formed from one side of the base portion 34 to be protruded to the outside, and a second supporting portion 38 which is integrally protruded from the other side of the base portion 34 to be opposite to the first supporting portion 36. On an inner portion of the first supporting portion 36 is formed a first partial track groove 40 in which a portion of the track portion 28 of the inner shuttle 22 is rotatably inserted. On an inner portion of the second supporting portion 38 is formed a second partial track groove 42 in which a portion of the track portion 28 of the inner shuttle 22 is also rotatably inserted. Further, a first fixing groove 44 is formed at an end of an outer face of the first supporting portion 36. A second fixing groove 46 is formed at one end of an outer face of the second supporting portion 38 corresponding to the end of the outer face of the first supporting portion 36, and a third fixing groove 48 is formed at the other end of the outer face of the second supporting portion 38. Particularly, as shown in FIG. 5, it is preferred that a circumference of each fixing groove 44, 46, 48 formed at each supporting portion forms an acute angle so that a track groove member and a groove member are fixedly coupled to the supporting portions as described below.

The outer shuttle 20 is provided with the separate track groove member 50 that is removably coupled to the main body 32. On an inner face of the track groove member 50, there is formed a third partial track groove 52 in which a portion of the track portion 28 of the inner shuttle 22 is inserted. When the track groove member 50 is fixedly coupled to the first and second supporting portions 36, 38, the third partial track groove 52 is communicated with the first partial track groove 40 of the first supporting portion 36 and the second partial track groove 42 of the second supporting member 36. Particularly, the track groove member 50 is formed with a first fixing piece 54 which is integrally formed at one end thereof to be removably coupled to the first fixing groove 44 of the first supporting portion 36, and a second fixing piece 56 which is integrally formed at the other end thereof to be removably coupled to the second fixing groove 46 of the second supporting portion 38. Preferably, a circumference of each fixing piece 54, 56 forms an acute angle corresponding to the circumference of each fixing groove 44, 46 so as to be fixedly coupled to each fixing groove 44, 46.

In addition, the outer shuttle 20 of the rotary shuttle device of the present invention is farther provided with the groove member 58 that is removably coupled to the main body 32. On an inner face of the groove member 58, there is formed a fourth partial track groove 60 in which a portion of the track portion 28 of the inner shuttle 22 is inserted. When the groove member 58 is fixedly coupled to the second supporting portion 38, the fourth partial track groove 60 is communicated with the second partial track groove 42 of the second supporting portion 38. The groove member 58 is formed with a pointed end 62 formed at one end thereof, and a groove 64 which is formed adjacent to the pointed end 62 and through which an under thread is passed through the groove 64 while being contacted therewith. Particularly, at the other end of the groove member 58, there is integrally formed a third fixing piece 66 which is removably coupled to the third fixing groove 48 formed at the second supporting portion 38 of the main body 32. Preferably, a circumference of the third fixing piece 66 forms an acute angle corresponding to the circumference of the third fixing groove 48 so as to be fixedly coupled to the third fixing groove 48.

In order to fixedly couple the track groove member 50 and the groove member 58 to the second supporting portion 38 of the main body 32, there is provided a bracket 70 having a plurality of fixing holes 68. The second supporting portion 38, the track groove member 50 and the groove member 58 respectively have a fastening hole corresponding to each fixing hole for at a place of the bracket 70. That is, the second supporting portion 38 has the fastening holes 72, the track groove member 50 has the fastening holes 74 and the groove member 58 has the fastening holes 76.

Meanwhile, according to various embodiments of the present invention, a coupling method among the constructing elements of the outer shuttle 20 can be variously realized.

Figure 4:
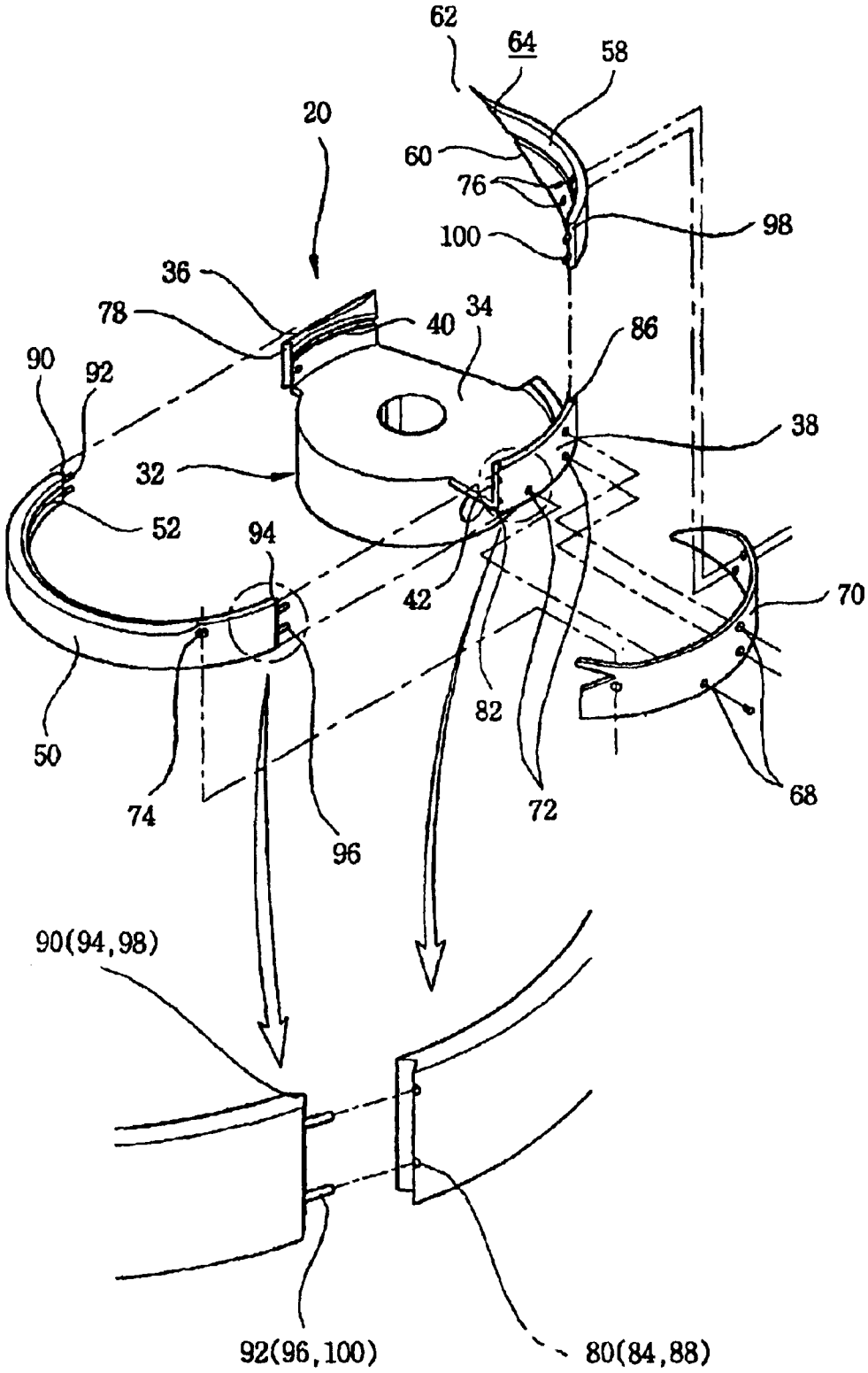
FIG. 4 is an exploded perspective view of the outer shuttle of the rotary shuttle device according to other embodiment of the present invention.

As shown in FIG. 4, the constructing elements of the outer shuttle 20 may be removably coupled each other by a groove and pin coupling method. That is, at an end of the first supporting portion 36 of the main body 32, there is formed a locking groove 78 having one or more locking holes 80. Moreover, the second supporting portion 38 has a second locking groove 82 formed at one end thereof, and a third locking groove 86 formed at the other end thereof. The second locking groove 82 has two locking holes 84, and the third locking groove 86 also has two locking holes 88. Preferably, each of the locking grooves 78, 82, 86 forms an acute angle.

Corresponding to each of the first and second supporting portions 36, 38, at one end of the track groove member 50 is formed a first locking side 90 which is removably inserted into the first locking groove 78 of the first supporting portion 36. The first locking side 90 has a locking pin 92 that is removably coupled to each locking hole 80. And at the other end of the tracking groove member 50 is formed a second locking side 94 which is removably inserted into the second locking groove 82 of the second supporting portion 38. The second locking side 94 has a locking pin 96 that is removably coupled to each locking hole 84. Further, at one end of the groove member 58 that is removably mounted at the second supporting portion 38, there is formed a third locking side 98 which is inserted into the third locking groove 86 formed at the other end of the second supporting portion 38. The third locking side 98 has a locking pin 100 that is removably coupled to each locking hole 88. Preferably, each of the locking sides 90, 94, 98 has the same acute angle as that of each locking groove 78, 82, 86 so as to be exactly inserted into each locking groove 78, 82, 86.

Meanwhile, as shown in FIG. 5, the constructing elements of the outer shuttle 20 may be removably coupled each other using coupling means such as a bolt. That is, at an end of the first supporting portion 36 of the main body 32, there is formed a first coupling portion 102 that is formed into a step type. The first coupling portion 102 has a coupling hole 104. At one end of the second supporting portion 38 of the main body 32, there is formed a second coupling portion 106 that is formed into the step type. The second coupling portion 106 has a coupling hole 108. And at the other end of the second supporting portion 38 is formed a third coupling portion 110 that is formed into the step type. The third coupling portion 110 has a coupling hole 112. Particularly, each end 114, 116, 118 formed by a horizontal portion and a vertical portion of each coupling portion 102, 106, 110 is formed into a groove type having an acute angle.

Corresponding to each supporting portion 36, 38, at one end of the track groove member 50, there is formed a first fastening portion 120 which is coupled to the first coupling portion 102 of the first supporting portion 36. The first fastening portion 120 is formed with a fastening hole 122 corresponding to the coupling hole 104 formed at the first coupling portion 102. At the other end of the track groove member 30, there is formed a second fastening portion 124 which is coupled to the first coupling portion 106 of the first supporting portion 38. The second fastening portion 124 has a fastening hole 126 corresponding to the coupling hole 108 formed at the second coupling portion 106. Further, at an end of the groove member 58 that is mounted at the second supporting portion 38, there is formed a third fastening portion 128 which is coupled to the third coupling portion 110 formed at the other end of the second supporting portion 38. The third fastening portion 128 has a fastening hole 130 corresponding to a coupling hole 112 of the third coupling portion 110. The coupling hole 104, 108, 112 formed at each coupling portion 102, 106, 110 and the fastening hole 122, 126, 130 formed at each fastening portion 120, 124, 128 are respectively coupled each other by a bolt B. Particularly, it is preferred that an edge portion 132, 134, 136 of each fastening portion 120, 124, 128 has the same acute angle as that of the end 114, 116, 118 of each coupling portion 102, 106, 110 so as to be exactly and fixedly inserted into the end 114, 116, 118 of each coupling portion 102, 106, 110.

While the coupling method of the constructing elements comprising the outer shuttle of the rotary shuttle device of the present invention have been described in detail with reference to the three coupling methods, those skilled in the art will appreciate that the two or three methods can also be combined properly and then used as well as the three coupling methods can be independently performed.

Hereinafter, the coupling method and operating mode of the rotary shuttle device for a sewing machine according to the present invention will be described fully.

For example, in case the constructing elements of the outer shuttle are coupled each other by an engaging and tightly fitting method, the first fixing piece 54 formed at one end of the track groove member 50 is inserted into the first fixing groove 44 of the first supporting portion 36, and at the same time, the second fixing piece 56 formed at the other end of the track groove member 50 is inserted into the second fixing groove 46 of the second supporting portion 38, so that the track groove member 50 is coupled to the main body 32. Then, the third fixing piece 66 of the groove member 58 is fixedly inserted into the third fixing groove 48 of the second supporting portion 38, so that the groove member 58 is coupled to the main body 32. When coupling the track groove member 50 and the groove member 58 to the main body as described above, the circumference of each fixing piece 54, 56, 66 forms the acute angle, and the circumference of each fixing groove 44, 46, 48 also forms the acute angle. Accordingly, the track groove member 50 and the groove member 58 are fixedly coupled to the main body 32.

Meanwhile, in case the constructing elements of the outer shuttle are coupled each other by a groove and pin coupling method, the first locking side 90 and the locking pin 92 formed at one end of the track groove member 50 is inserted into the first locking groove 78 and the locking hole 80 of the first supporting portion 36, and at the same time, the second locking side 94 and the locking pin 96 formed at the other end of the track groove member 50 is inserted into the second locking groove 82 and the locking hole 84 of the second supporting portion 38, so that the track groove member 50 is coupled to the main body 32. Then, the third locking side 98 and locking pin 100 of the groove member 58 is fixedly inserted into the third locking groove 86 and the locking hole 90 of the second supporting portion 38, so that the groove member 58 is coupled to the main body 32. Since each of the locking sides 90, 94, 98 has the same acute angle as that of each locking groove 78, 82, 86, the track groove member 50 and the groove member 58 are fixedly and exactly coupled to the main body 32

Further, as shown in FIG. 5, in case the constructing elements of the outer shuttle are coupled each other by the fastening means such as the bolt, the fastening hole 122 of the first fastening portion 120 formed as one end of the track groove member 50 is communicated with the coupling hole 104 of the first coupling portion 102 of the first supporting portion 36, and the fastening hole 126 of the second fastening portion 124 formed as the other end of the track groove member 50 is communicated with the coupling hole 108 of the second coupling portion 106 of the first supporting portion 36. The bolt B is then fixedly inserted into the communicated holes, so that the track groove member 50 is coupled to the main body 32. Further, the fastening hole 130 of the third fastening portion 128 formed as the end of the groove member 50 is communicated with the coupling hole 112 of the third coupling portion 110 of the second supporting portion 38. Then, the bolt B is fixedly inserted into the communicated holes, so that the groove member 58 is coupled to the main body 32. When coupling the track groove member 50 and the groove member 58 to the main body as described above, the edge portion 132, 134, 136 of each fastening portion 120, 124, 128 has the same acute angle as that of the end 114, 116, 118 of each coupling portion 102, 106, 110 so as to be exactly and fixedly inserted into the end 114, 116, 118 of each coupling portion 102, 106, 110. Accordingly, the track groove member 50 and the groove member 58 are fixedly and exactly coupled to the main body 32.

Of course, the inner shuttle 22 has to be inserted into the outer shuttle 20 before the outer shuttle 20 is completely assembled. Further, after assembling the outer shuttle 20, the track groove member 50 and the groove member 58 are fixedly and integrally coupled to the main body 32 using the bracket 70. That is, each fixing hole 68 formed at a place of the bracket 70 is communicated with each fastening hole 72, 74, 76 formed at the second supporting portion 38, the track groove member 50 and the groove member 58. Then, the bolt B is fixed inserted into each of the communicated holes. Particularly, the fixing holes 68 of the bracket 70 may be formed corresponding to the fixing holes and the fastening holes of the track groove member 50 and the groove member 58. Therefore, when coupling the track groove member 50 and the groove member 58 are coupled to the main body 32, the bracket 70 can be simultaneously coupled by one bolt.

According to the rotary shuttle device of the present invention as described above, for example, in case the track groove member 50 of the outer shuttle 20 is excessively worn by the track portion of the inner shuttle 22, or the groove member 58 is excessively worn, only the worn portion can be selectively disassembled and then replaced.

Moreover, since the opening space for receiving the inner shuttle 22 in the outer shuttle 20 is wide, the inner shuttle 22 can be facilely and rapidly inserted into or separated from the outer shuttle 20.

As the result, according to the rotary shuttle device for the sewing machine of the present invention, since only the worn portion or the portion that requires replacement can be selectively replaced among the constructing elements of the outer shuttle, thereby reducing maintenance cost.

And since the main body, the groove member and the track groove member can be separately fabricated and also selectively replaced, thereby improving productivity and preventing waste of resources.

Further, since the inner shuttle can be facilely mounted in the outer shuttle, thereby improving convenience.

While the present invention has been described in detail, those skilled in the art will appreciate that various modifications and substitutions can be made thereto without departing from the spirit and scope of the present invention as set forth in the appended claims.

What is claimed is:

1. A rotary shuttle device for a sewing machine, comprising an outer shuttle disposed at a driving shaft of a power generating unit of the sewing machine, a bobbin rotatably disposed in an inner shuttle so that an under thread is wound thereon, a bobbin case for receiving the bobbin and a bracket disposed around the outer shuttle, wherein the outer shuttle comprises:

a main body integrally provided with a base portion disposed at the driving shaft, a first supporting portion which protrudes at one side of the base portion to have a first partial track groove on an inner face thereof, and a second supporting portion which protrudes at the other side of the base portion to be opposite the first supporting portion and having a second partial track groove on an inner face thereof;

a track groove member removably disposed between the first and second supporting portion and having a third partial track groove in communication with the first partial track groove of the first supporting portion and the second partial track groove of the second supporting portion; and a groove member removably fixed to the second supporting portion of the main body, and having a pointed end, a groove through which the under thread wound on the bobbin passes while being contacted therewith and a fourth partial track groove in communication with the second partial track groove of the second supporting portion, wherein:

the main body has a first fixing groove provided at an end of the first supporting portion, a second fixing groove provided at one end of the second supporting portion corresponding to the end of the first supporting portion, and a third fixing groove provided at the other end of the second supporting portion, the track groove member having a first fixing piece provided at one end thereof to be removably coupled to the first fixing groove of the first supporting member, and a second fixing piece provided at the other end thereof to be removably coupled to the second fixing groove of the second supporting portion, and the groove member having a third fixing piece formed at an end thereof to be removably coupled to the third fixing groove of the second supporting portion of the main body.

2. The device of claim 1, wherein the fixing grooves respectively have a circumference forming an acute angle, and a circumference of each fixing piece forms the same acute angle as that of each fixing groove.

3. A rotary shuttle device for a sewing machine, comprising an outer shuttle disposed at a driving shaft of a power generating unit of the sewing machine, a bobbin rotatably disposed in an inner shuttle so that an under thread is wound thereon, a bobbin case for receiving the bobbin and a bracket disposed around the outer shuttle, wherein the outer shuttle comprises:

a main body integrally provided with a base portion disposed at the driving shaft, a first supporting portion which protrudes at one side of the base portion to have a first partial track groove on an inner face thereof, and a second supporting portion which protrudes at the other side of the base portion to be opposite the first supporting portion and having a second partial track groove on an inner face thereof;

a track groove member removably disposed between the first and second supporting portion and having a third partial track groove in communication with the first partial track groove of the first supporting portion and the second partial track groove of the second supporting portion; and a groove member removably fixed to the second supporting portion of the main body, and having a pointed end, a groove through which the under thread wound on the bobbin passes while being contacted therewith and a fourth partial track groove in communication with the second partial track groove of the second supporting portion, wherein:

the main body has a first locking groove provided at an end of the first supporting portion, a second locking groove provided at one end of the second supporting portion corresponding to the end of the first supporting portion, and a third locking groove provided at the other end of the second supporting portion, the track groove member having a first locking side provided at one end thereof to be removably coupled to the first locking groove of the first supporting member, and a second locking side formed at the other end thereof to be removably coupled to the second locking groove of the second supporting portion, and the groove member having a third locking side provided at an end thereof to be removably coupled to the third locking groove of the second supporting portion of the main body.

4. The device of claim 3, wherein the locking grooves are respectively formed with locking holes and each of the locking sides has a locking pin removably inserted into each of the locking holes.

5. The device of claim 3, wherein the locking grooves respectively form an acute angle, and each of the locking sides has the same acute angle as each locking groove.

6. A rotary shuttle device for a sewing machine, comprising an outer shuttle disposed at a driving shaft of a power generating unit of the sewing machine, a bobbin rotatably disposed in an inner shuttle so that an under thread is wound thereon, a bobbin case for receiving the bobbin and a bracket disposed around the outer shuttle, wherein the outer shuttle comprises:

a main body integrally provided with a base portion disposed at the driving shaft. a first supporting portion which protrudes at one side of the base portion to have a first partial track groove on an inner face thereof, and a second supporting portion which protrudes at the other side of the base portion to be opposite the first supporting portion and having a second partial track groove on an inner face thereof;

a track groove member removably disposed between the first and second supporting portion and having a third partial track groove in communication with the first partial track groove of the first supporting portion and the second partial track groove of the second supporting portion; and a groove member removably fixed to the second supporting portion of the main body, and having a pointed end, a groove through which the under thread wound on the bobbin passes while being contacted therewith and a fourth partial track groove in communication with the second partial track groove of the second supporting portion, wherein:

the main body has a first coupling portion formed at an end of the first supporting portion, a second coupling portion formed at one end of the second supporting portion corresponding to the end of the first supporting portion, and a third coupling portion formed at the other end of the second supporting portion, and the first, second and third coupling portions being respectively provided with a coupling hole, the track groove member having a first fastening portion provided at one end thereof, and a second fastening portion provided at the other end thereof, and the first fastening portion having a fastening hole in communication with the coupling hole of the first coupling portion of the first supporting portion and coupled to the coupling hole by a bolt, and the second fastening portion having a fastening hole in communication with the coupling hole of the second coupling portion of the second supporting portion and coupled to the coupling hole by the bolt, and the groove member having a third fastening portion formed at an end thereof, and the third fastening portion having a fastening hole in communication with the coupling hole of the third coupling portion of the second supporting portion and coupled to the coupling hole by the bolt.

7. The device of claim 6, wherein the coupling hole formed at the third coupling portion of the second supporting portion and the fastening hole provided at the third fastening of the groove member are provided to be communicated with fixing holes provided at a bracket and commonly coupled through a communication hole by the bolt.

8. The device of claim 6, wherein the coupling portions respectively have end provided by horizontal portion and vertical portions of the coupling portions, and each end being formed into a groove having an acute angle, and the fastening portions respectively having edge portions with the same acute angle as that of each end.

9. The device of claim 7, wherein the second supporting portion of the main body has a fastening hole coupled to one of the fixing holes provided at the bracket by the bolt, and the track groove member having a fastening hole coupled to one of the fixing holes formed at the bracket by the bolt, and the groove member having a fastening hole coupled to one of the fixing holes provided at the bracket by the bolt.

* * * * *